US006147664A

United States Patent [19]

Hansen

[11] Patent Number: 6,147,664

[45] **Date of Patent: *Nov. 14, 2000**

[54] CONTROLLING THE BRIGHTNESS OF AN FED DEVICE USING PWM ON THE ROW SIDE AND AM ON THE COLUMN SIDE

[75] Inventor: Ronald L. Hansen, San Jose, Calif.

[73] Assignee: Candescent Technologies Corporation, San Jose, Calif.

[ * ] Notice: This patent is subject to a terminal disclaimer.

[21] Appl. No.: 09/164,402

[22] Filed: Sep. 30, 1998

Related U.S. Application Data

[63] Continuation-in-part of application No. 08/920,552, Aug. 29, 1997.

[51] Int. Cl.[7] ..... G09G 3/22; G09G 3/36; G09G 3/30

[52] U.S. Cl. ..... 345/74.1; 345/98; 345/76; 345/100; 345/102; 315/169.1

[58] Field of Search ..... 345/74, 75, 47, 345/76, 98, 77, 100, 102, 147, 63; 313/498–512; 327/421; 349/31; 378/122; 438/983; 439/950; 315/169.1–169.3

[56] References Cited

U.S. PATENT DOCUMENTS

| | | | |
|---|---|---|---|
| 3,629,653 | 12/1971 | Irwin et al. | 315/169 |
| 3,674,928 | 7/1972 | Yoshiyama et al. | 178/7.3 D |
| 3,982,063 | 9/1976 | Brown et al. | 178/6 |
| 4,130,777 | 12/1978 | De Jule | 315/169 TV |
| 4,170,772 | 10/1979 | Bly | 340/781 |
| 4,694,225 | 9/1987 | Tomii et al. | 315/366 |
| 4,758,828 | 7/1988 | Mitsumori | 340/703 |
| 5,103,145 | 4/1992 | Doran | 315/381 |
| 5,194,780 | 3/1993 | Meyer | 315/169.3 |
| 5,262,698 | 11/1993 | Dunham | 315/169.1 |
| 5,357,172 | 10/1994 | Lee et al. | 315/167 |
| 5,402,143 | 3/1995 | Ge et al. | 345/102 |
| 5,428,370 | 6/1995 | Knapp et al. | 345/205 |
| 5,459,480 | 10/1995 | Browing et al. | 345/75 |
| 5,477,110 | 12/1995 | Smith et al. | 315/169.3 |
| 5,541,473 | 7/1996 | Dubocg Jr. et al. | 313/422 |
| 5,559,389 | 9/1996 | Spindt et al. | 313/310 |
| 5,564,959 | 10/1996 | Spindt et al. | 445/24 |
| 5,578,899 | 11/1996 | Haven et al. | 313/422 |
| 5,581,159 | 12/1996 | Lee et al. | 315/167 |
| 5,600,345 | 2/1997 | Dingwall et al. | 345/100 |
| 5,607,335 | 3/1997 | Spindt et al. | 445/50 |
| 5,608,283 | 3/1997 | Twichell et al. | 313/309 |
| 5,625,373 | 4/1997 | Johnson | 345/58 |
| 5,659,328 | 8/1997 | Todokoro et al. | 345/74 |
| 5,708,451 | 1/1998 | Baldi | 345/75 |
| 5,801,671 | 9/1998 | Kobayashi et al. | 345/95 |
| 5,856,812 | 1/1999 | Hush et al. | 345/74 |
| 5,898,415 | 4/1999 | Hansen et al. | 345/74 |
| 5,910,792 | 6/1999 | Hansen et al. | 345/74 |
| 5,949,393 | 9/1999 | Sakai et al. | 345/74 |
| 6,034,810 | 3/2000 | Robinson et al. | 359/293 |

*Primary Examiner*—Vijay Shankar
*Assistant Examiner*—Jeff Piziali
*Attorney, Agent, or Firm*—Wagner, Murabito & Hao LLP

[57] ABSTRACT

A circuit and method for controlling the brightness of a display screen implemented using a flat panel field emission display (FED) screen. Within the FED screen, a matrix of rows and columns is provided and emitters are situated within each row-column intersection. Rows are activated sequentially and separate gray scale information is presented to the columns. When the proper voltage is applied across the cathode and anode of the emitters, they release electrons toward a phosphor spot, e.g., red, green, blue, causing an illumination point. The present invention includes brightness control circuitry positioned across the row drivers for altering row on-time of the applied voltage to the rows causing a uniform change in brightness cross the FED screen. The applied voltage is pulse width modulated to alter the brightness of the FED screen. Because the relative column voltages remain constant within the present invention, gray scale resolution or the gamma or the white point balance of the screen is not compromised as brightness is altered. Brightness is increased for an increase in the on-time window and decreased for a decrease in the on-time window.

23 Claims, 12 Drawing Sheets

75

550

CONTROLLING THE BRIGHTNESS OF AN FED DEVICE USING PWM ON THE ROW SIDE AND AM ON THE COLUMN SIDE

RELATED UNITED STATES PATENT APPLICATION

This patent application is a continuation-in-part of pending U.S. patent application Ser. No. 08/920,552, filed Aug. 29, 1997, entitled "A Circuit and Method for Controlling the Brightness of An FED Device," CDST-E077, by Ronald L. Hansen, and assigned to the assignee of the present invention.

BACKGROUND OF THE INVENTION

1. Field of the Invention

The present invention relates to the field of flat panel display screens. More specifically, the present invention relates to the field of flat panel field emission displays (FEDs).

2. Related Art

Flat panel FED display devices, also called thin CRTs, include a flat panel screen having rows and columns of intersecting lines. The lines intersect to form subpixels. In the past, amplitude modulated (AM) voltage signals have been applied to the column lines in order to display images on the FED screen. Pulse width modulation (PWM) has been proposed for gray scale generation. In low-capacitance panels and in low gray scale generation situations, this technique may have application. However, in high capacitance (e.g., about 1 pf/subpixel) panels and 256 gray scale situations, PWM is not useful and in the general case consumes too much power. In these situations, PWM has not been used generally for carrying the image data to the columns because of certain time restraints inherent in the FED screen display technique. For instance, in order to provide 256 different gray scale levels, the time period allotted for each column driver must be divided into at least 256 discrete time intervals. Assuming a display having 400 rows, the 1/60 sec frame update rate is divided by 400 yielding a 1/24,000 sec time frame in which all columns need to be updated.

However, there are many columns that must be updated during this time period. This leads to a less than 60 ns pulse width (per column) to support, for instance, the XGA video format. Also, with less than 5 ns rise times for typical driver circuitry, the drivers and displays have less than 10 ohm impedance paths. These requirements unfortunately prohibit PWM gray scale with 1 pf/subpixel displays because it is not practical to divide the small column drive time into the many discrete time intervals required for PWM given the limited rise and fall times of the driver circuits. In addition, PWM increases the $CV^2$ losses over the AM technique in most cases.

In the field of flat panel display devices, it is often necessary to adjust the brightness of the display screen. AM has been used in the past to adjust the brightness of a FED device. However, with AM, the operating point of the emission cathode is changed thereby possibly affecting the gamma (e.g., v-i characteristics of the subpixels) and white point balance of the display screen. It would be desirable to provide a brightness adjustment that did not affect the gamma or white balance of the display screen.

Active matrix liquid crystal devices (AMLCDs) typically contain one or more backlighting lamps that project light through the active matrix of liquid crystal cells. The brightness adjustment of AMLCD devices alters the gray scale resolution of the pixels. These flat panel display screens alter the brightness of the display by controlling the electrical drive to, and hence the intensity of, the backlighting lamp. However, by its nature, the color and the uniformity produced by an AMLCD device degrade as the backlighting lamp is moved away from an optimum brightness point. The optimum brightness point is typically factory set. By altering the gray scale resolution of the pixels when performing brightness adjustment, this prior art method of altering the brightness of a flat panel display has the unfortunate side effect of degrading the quality of the displayed image. It is desirable to provide a brightness adjustment for a flat panel display screen that does not compromise the gray scale quality of the pixels.

In another prior art mechanism for altering the brightness of an AMLCD, the image data used to render an image on the screen is altered as it is fed to the display. A function composed of a gain and an offset value is programmed into the display and all image data is then passed through the function which multiplies the data by the gain value and then adds the programmed offset value. The values of the above function are then altered as the brightness needs to be increased or decreased. This prior art mechanism for altering screen brightness is disadvantageous because it requires relatively complex circuitry for altering the large volume of image data. Secondly, this prior art mechanism degrades the gray scale quality of the image by altering the gray scale resolution of the flat panel display. It is desirable to provide a brightness adjustment for a flat panel display screen that does not alter the image data nor compromise the gray scale resolution of the image.

Flat panel field emission displays (FEDs) do not use backlighting lamps. Flat panel FEDs utilize emitters each having an anode and a cathode and a gate. The voltage applied across an individual emitter (gate to cathode) causes it to release electrons toward a phosphor spot located on a display screen. Many emitters are associated with a single phosphor spot. A pixel is composed of three (e.g., red, green and blue) independently controlled phosphor spots. The gray scale content of a pixel within a flat panel FED screen is represented by the voltages applied to the red, green and blue emitters that constitute the pixel. However, a brightness adjustment mechanism that alters the relative voltages applied to the emitters of the red, green and blue phosphor spots will vary the gray scale quality of the pixels within a flat panel FED screen. It is desirable to provide a brightness adjustment for a flat panel FED screen that does not compromise the gray scale resolution of the pixels.

One prior art mechanism for altering the brightness of an FED alters the high voltage (e.g., several kilovolts) applied to the emitter's anode. This method is disadvantageous because it requires a variable output high voltage power supply which is more complex and hence more expensive than a constant voltage output power supply. Secondly, this prior art mechanism requires that the brightness adjustment circuitry be implemented with high voltage components rather than less expensive, simpler low voltage components. It is desirable to provide a brightness adjustment for a flat panel FED screen that does not require altering high voltage levels nor that requires high voltage components.

Accordingly, the present invention provides a mechanism and method for controlling the brightness of a flat panel display screen that does not compromise the gray scale resolution of the pixels of the display screen. The present invention also provides a mechanism for altering the brightness of a flat panel display screen that does not alter the image data. The present invention also provides a mechanism for altering the brightness of a flat panel display screen that does not alter the gamma or white balance of the display screen. These and other advantages of the present invention not specifically mentioned above will become clear within discussions of the present invention presented herein.

SUMMARY OF THE INVENTION

A circuit and method are described herein for controlling the brightness of a display screen implemented using a flat panel field emission display (FED) screen. Within the flat panel FED screen, a matrix of rows and columns is provided and emitters are situated within each row-column intersection. Rows are activated sequentially and separate gray scale information is presented to the columns. In one embodiment, rows are activated sequentially from the top most row down to the bottom row with only one row asserted at a time. Alternatively, the rows can be interlaced. When the proper voltage is applied across the cathode and gate of the emitters, they release electrons toward a phosphor spot, e.g., red, green, blue, causing an illumination point. Therefore, each pixel contains one red, one green and one blue phosphor spot, "subpixel."

It is desirable to minimize drive power while maximizing visual display performance. The present invention utilizes amplitude modulation (AM) for gray scale generation via the column drivers and pulse width modulation (PWM) for dimming (brightness control) via the row drivers to accomplish this goal. Within the present invention FED screen, only one row is enabled at any one time, so the row drive is by its nature a pulsed operation. However, since row "on-times" are larger than 17 us (e.g., for XGA video formats), the rise time and drive impedances become more reasonable, especially for simultaneous panel-wide modulation. Thus, for functions like dimming (e.g., brightness control), the row on time window is uniformly shortened in accordance with the present invention to thereby reduce the brightness of the entire screen without changing the instantaneous v-i characteristic of the driven subpixels.

In one embodiment, the present invention includes specialized circuitry common to all the row drivers for altering the pulse width of the enable voltage applied to the rows to cause a change in brightness cross the FED screen. Brightness is substantially linearly related to the enable pulse width. The applied voltage is pulse width modulated to alter the brightness of the flat panel FED screen. Because the relative column voltages remain constant within this embodiment of the present invention, gray scale resolution is not compromised as brightness is altered. In one embodiment, the enable lines of the row drivers are turned on and off to modulate the pulse width ("on-time") of the row voltage. In a second embodiment, the row driver power supply is interrupted to modulate the pulse width ("on-time") of the row voltage. It is more efficient to alter the row voltage than the column voltage. This is the case because there is no increase in $CV^2$ loss with row modulation.

Specifically, embodiments of the present invention include a field emission display screen including: a plurality of column drivers for driving amplitude modulated voltage signals over a plurality of column lines wherein each column driver is coupled to a respective column line and receives image data for the respective column line; a plurality of row drivers for driving a voltage pulse over a plurality of row lines wherein each row driver is coupled to a respective row line, the plurality of row lines intersecting the plurality of column lines and wherein a subpixel is defined as an intersection of one row line and one column line; an enable circuit for enabling only one row driver at a time, the enable circuit coupled to each row driver of the plurality of row drivers; and a pulse width modulation circuit for generating the voltage pulse wherein the pulse width modulation circuit is for varying the width of the voltage pulse in order to effect brightness within the FED screen without loss of gray scale resolution capability of the FED screen.

DETAILED DESCRIPTION OF THE INVENTION

In the following detailed description of the present invention, a method and mechanism to alter the brightness of an FED flat panel screen by pulse width modulation of the row drivers and amplitude modulation of the column drivers, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

Figure 1:
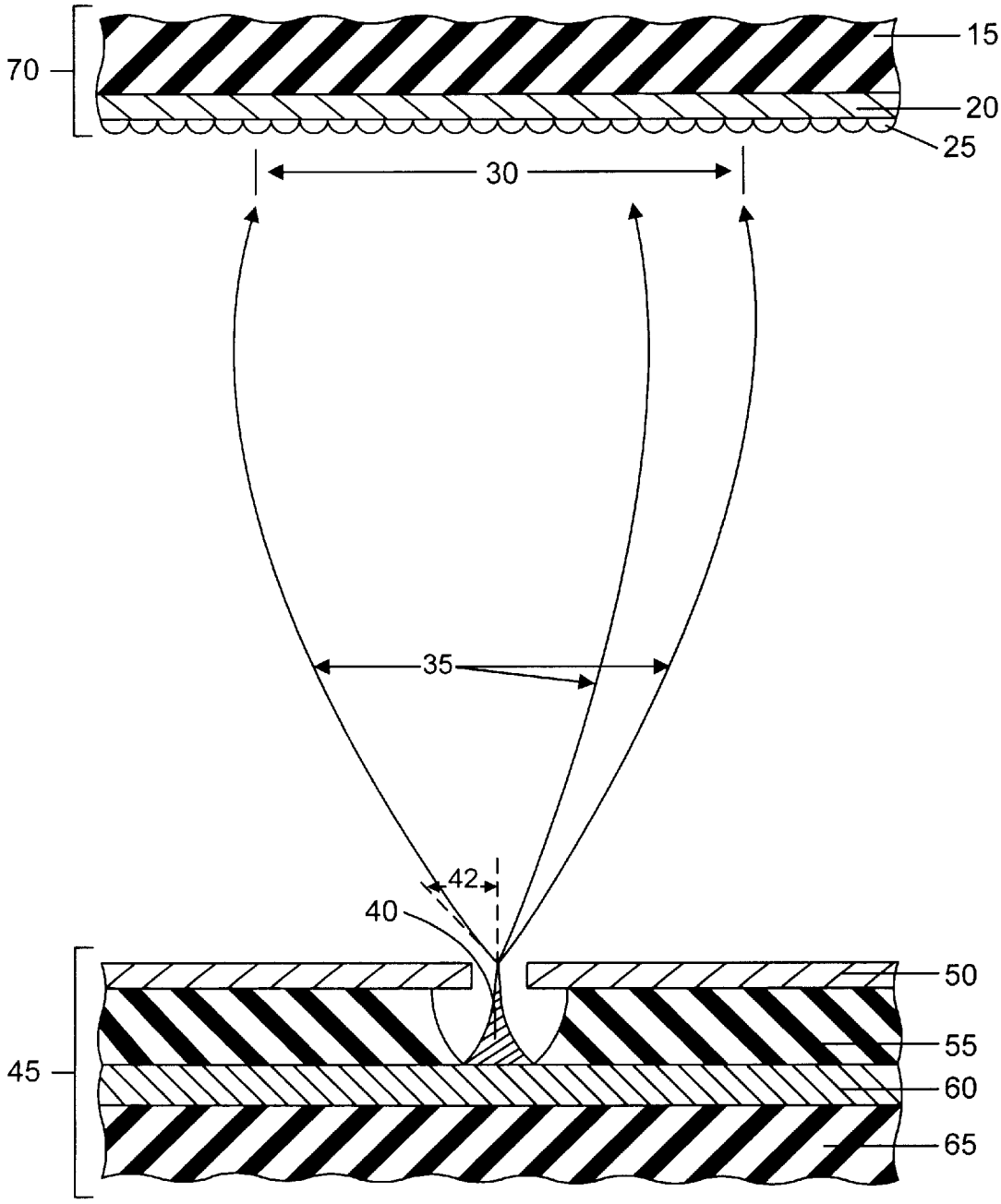
FIG. 1 is a cross section structural view of part of a flat panel FED screen that utilizes a gated field emitter situated at the intersection of a row and a column line.

A discussion of an emitter of a field emission display (FED) is presented. FIG. 1 illustrates a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display 75. Faceplate structure 70 is formed with an electrically insulating faceplate 15, an anode 20, and a coating of phosphors 25. Electrons emitted from element 40 are received by phosphors portion 30.

Anode 20 of FIG. 1 is maintained at a positive voltage relative to cathode 60/40. The anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. The phosphors struck by the emitted electrons produce light of a selected color and represent a phosphor spot. A single phosphor spot can be illuminated by thousands of emitters.

Phosphors 25 are a subpixel part of a picture element ("pixel") that contains other phosphors (not shown) which emit light of different color than that produced by phosphors 25. Typically a pixel contains three phosphor spots or "subpixels," a red spot, a green spot and a blue spot. Also, the pixel containing phosphors 25 adjoins one or more other pixels (not shown) in the FED flat panel display. If some of the electrons intended for phosphors 25 consistently strike other phosphors (in the same or another pixels), the image resolution and color purity can become degraded. As discussed in more detail below, the pixels of an FED flat panel screen are arranged in a matrix form including columns and rows. In one implementation, a pixel is composed of three phosphor spots ("subpixels") aligned in the same row, but having three separate columns. Therefore, a single pixel is uniquely identified by one row and three separate columns (a red column, a green column and a blue column). In one embodiment, the total area of the three subpixels is substantially square.

The size of target phosphor portion 30 depends on the applied voltages and geometric and dimensional characteristics of the FED flat panel display 75. Increasing the anode/phosphor voltage to 1,500 to 10,000 volts in the FED flat panel display 75 of FIG. 1 requires that the spacing between the backplate structure 45 and the faceplate structure 70 be much greater than 100–200 um. Increasing the interstructure spacing to the value needed for a phosphor potential of 1,500 to 10,000 volts causes a larger phosphor portion 30, unless electron focusing elements (e.g., gated field emission structures) are added to the FED flat panel display of FIG. 1. Such focusing elements can be included within FED flat panel display structure 75 and are described in U.S. Pat. No. 5,528,103 issued on Jun. 18, 1996 to Spindt, et al., which is incorporated herein by reference.

Importantly, the brightness of the target phosphor portion 30 depends on the voltage potential applied across the cathode 60/40 and the gate 50. The larger the voltage potential, the brighter the target phosphor portion 30. Secondly, the brightness of the target phosphor portion 30 depends on the amount of time a voltage is applied across the cathode 40/60 and the gate 50 (e.g., on-time window). The larger the on-time window, the brighter the target phosphor portion 30. Therefore, the brightness of FED flat panel structure 75 is dependent on the voltage and the amount of time (e.g., "on-time") the voltage is applied across cathode 60/40 and the gate 50. As discussed in more detail below, brightness is adjusted uniformly over the FED display screen by adjusting the pulse width of the on-time window for all row drivers.

Figure 2:
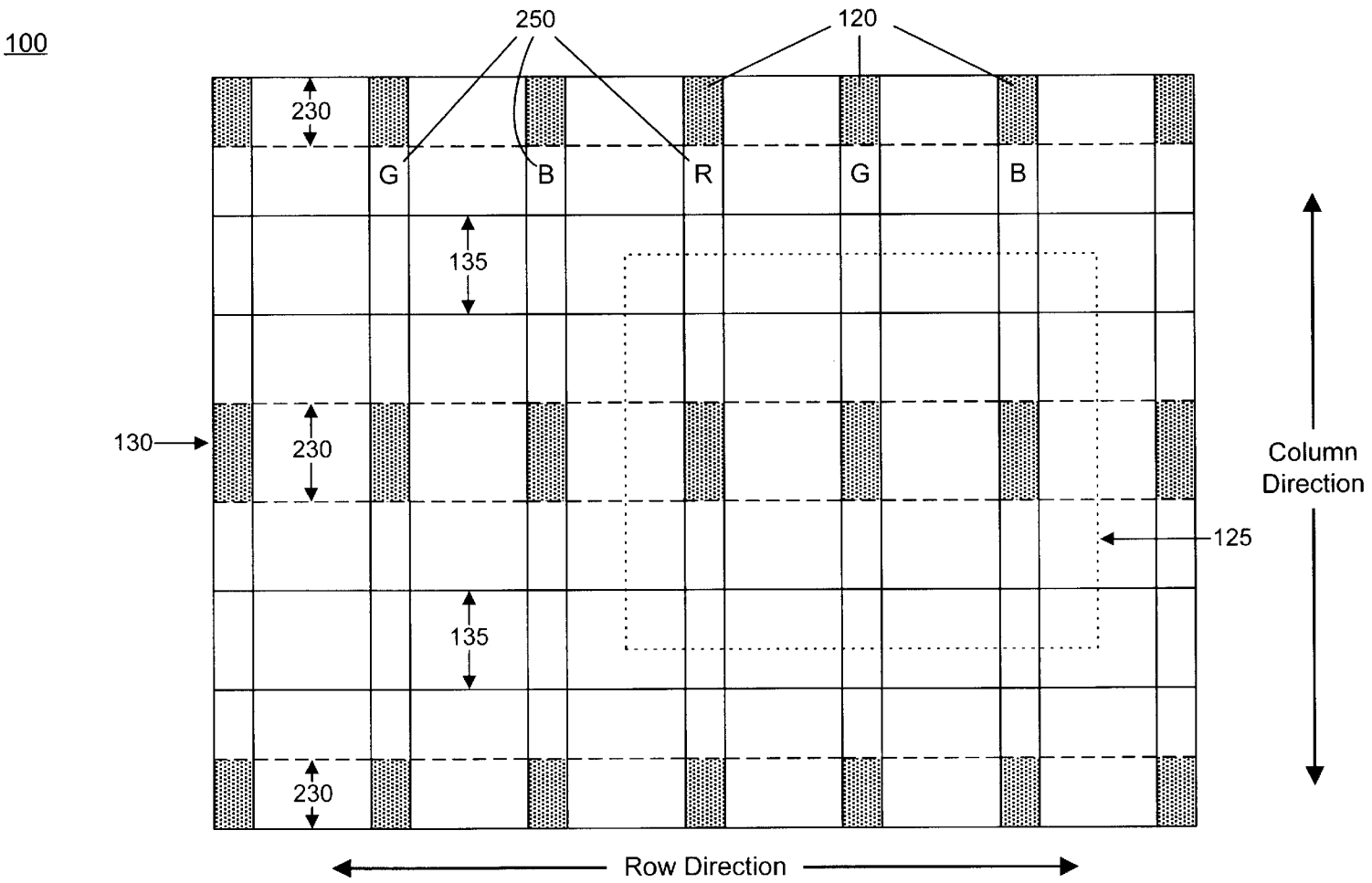
FIG. 2 is a plan view of internal portions of the flat panel FED screen of the present invention and illustrates several intersecting rows and columns of the display.

As shown in FIG. 2, the FED flat panel display is subdivided into an array of horizontally aligned rows and vertically aligned columns of pixels. A portion 100 of this array is shown in FIG. 2. The boundaries of a respective pixel 125 are indicated by dashed lines. Three separate emitter lines 230 are shown. Each emitter line 230 is a row electrode for one of the rows of pixels in the array. The middle row electrode 230 is coupled to the emitter cathodes 60/40 (FIG. 1) of each emitter of the particular row associated with the electrode. A portion of one pixel row is indicated in FIG. 2 and is situated between a pair of adjacent spacer walls 135. A pixel row is comprised of all of the pixels along one row line 250. Two or more pixels rows (and as much as 24–100 pixel rows), are generally located between each pair of adjacent spacer walls 135. Each column of pixels has three gate lines 250: (1) one for red; (2) a second for green; and (3) a third for blue. Likewise, each pixel column includes one of each phosphor stripes (red, green, blue), three stripes total. Each of the gate lines 250 is coupled to the gate 50 (FIG. 1) of each emitter structure of the associated column. This structure 100 is described in more detail in U.S. Pat. No. 5,477,105 issued on Dec. 19, 1995 to Curtin, et al., which is incorporated herein by reference.

The red, green and blue phosphor stripes 25 are maintained at a positive voltage of 1,500 to 10,000 volts relative to the voltage of the emitter-electrode 60/40. When one of the sets of electron-emission elements 40 is suitably excited by adjusting the voltage of the corresponding row (cathode) lines 230 and column (gate) lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. Frames are presented at 60 Hz. Assuming n rows of the display array, each row is energized at a rate of 16.7/n ms. The above FED 100 is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Figure 3A:
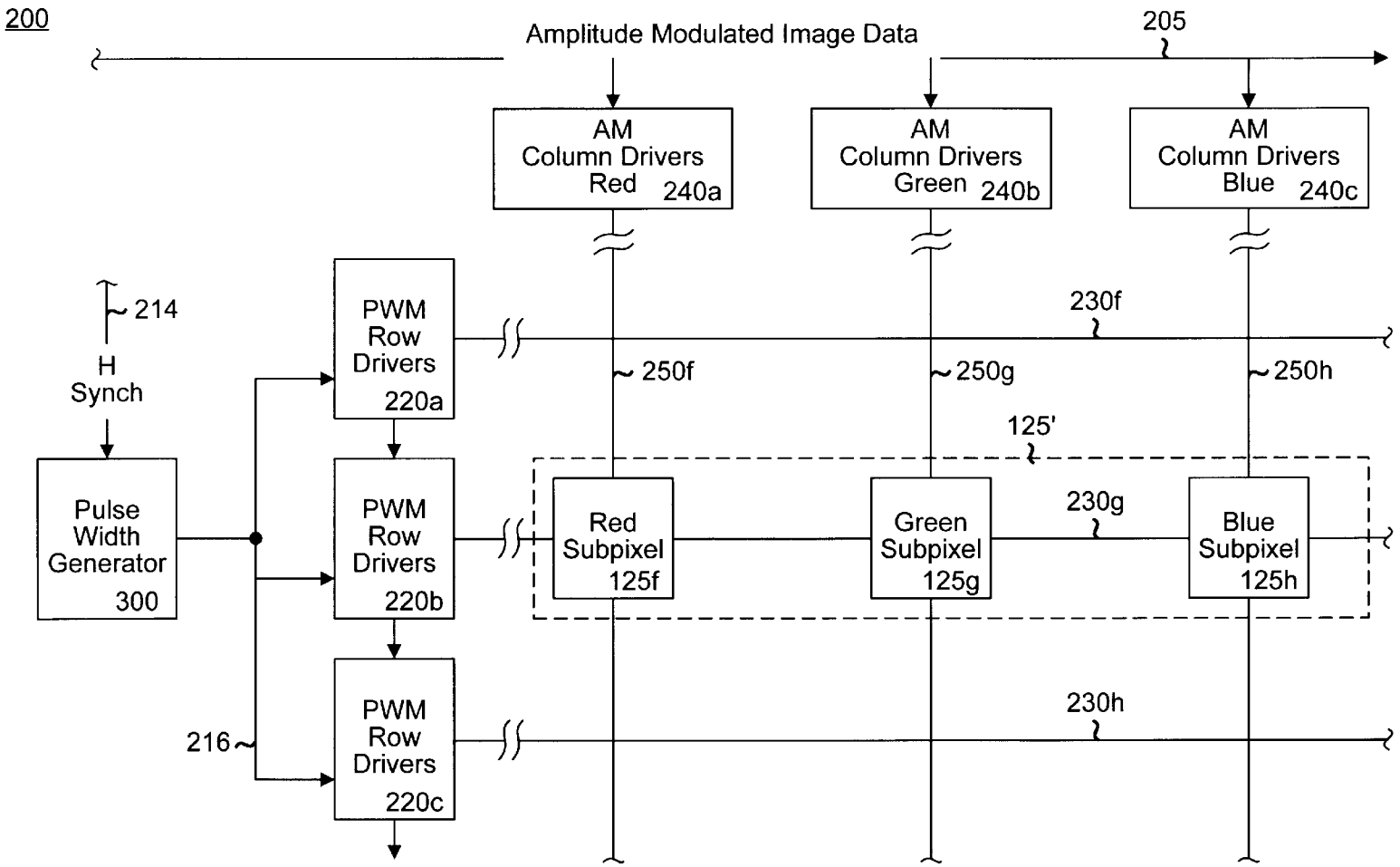
FIG. 3A illustrates brightness control circuitry of the present invention for using PWM for the row drive and AM for the column drive within a flat panel FED screen.

FIG. 3A illustrates a blow up of circuitry used by the present invention within the FED flat panel display screen 200 to perform uniform brightness control. An exemplary pixel 125' is shown having three subpixels, 125*f* (red), 125*g* (green) and 125*h* (blue). The three subpixels exist within a common row line 230*g* and have three separate column lines 250*f*, 250*g* and 250*h*. Each column line is driven by its own column driver, 240*a*, 240*b* and 240*c*, respectively. There are many more column lines and column drivers (not shown) within FED screen 200. Three row lines are shown, 230*f*, 230*g* and 230*h* and each row line is driven by its own row driver circuit 220*a*, 220*b* and 220*c*, respectively. There are many more row lines and row drivers (not shown) within FED screen 200. In operation, AM column data is latched into the column drivers 240 and only one row is enabled (during the on-time window) at any time to update the pixels of that row. This process is performed for each row of the display screen 200.

The AM image data is presented over data line 205 of FIG. 3A. A horizontal synchronization clock signal 214 synchronizes the updating of the rows. Clock signal 214 is fed to a pulse width generator circuit 300 which generates the pulse width of the row on-time window. Therefore, the start of each row on-time window is synchronized with the horizontal synchronization clock signal 214 and the pulse width of each on-time window is adjusted by the pulse width generator 300. Consecutive row on-time windows do not overlap in time since only one row is enabled at any time. In a typical refresh rate, the horizontal synchronization clock 214 is presented at a rate of between 15–30 us.

To alter the brightness of the overall display 200 of. FIG. 3A, the AM signals over line 205 remain unchanged, but the pulse width generator 300 varies the pulse width of the on-time window which acts as an enable pulse for the row drivers 220. To increase brightness, the pulse width (e.g., the on-time window) is increased and to decrease brightness, the pulse width (e.g., the on-time window) is decreased. Every subpixel of display 200 is effected uniformly for a change in the on-time window since each row driver 220 receives the same on-time pulse over the common enable line 216. By varying the brightness in this fashion, the gamma and white balance and gray scale resolution of the display 200 remain unchanged because the AM signals over line 205 remain unchanged. In one embodiment, the total area of the 3 subpixels 125*d*, 125*g* and 125*h* is substantially square in geometry.

Figure 3B:
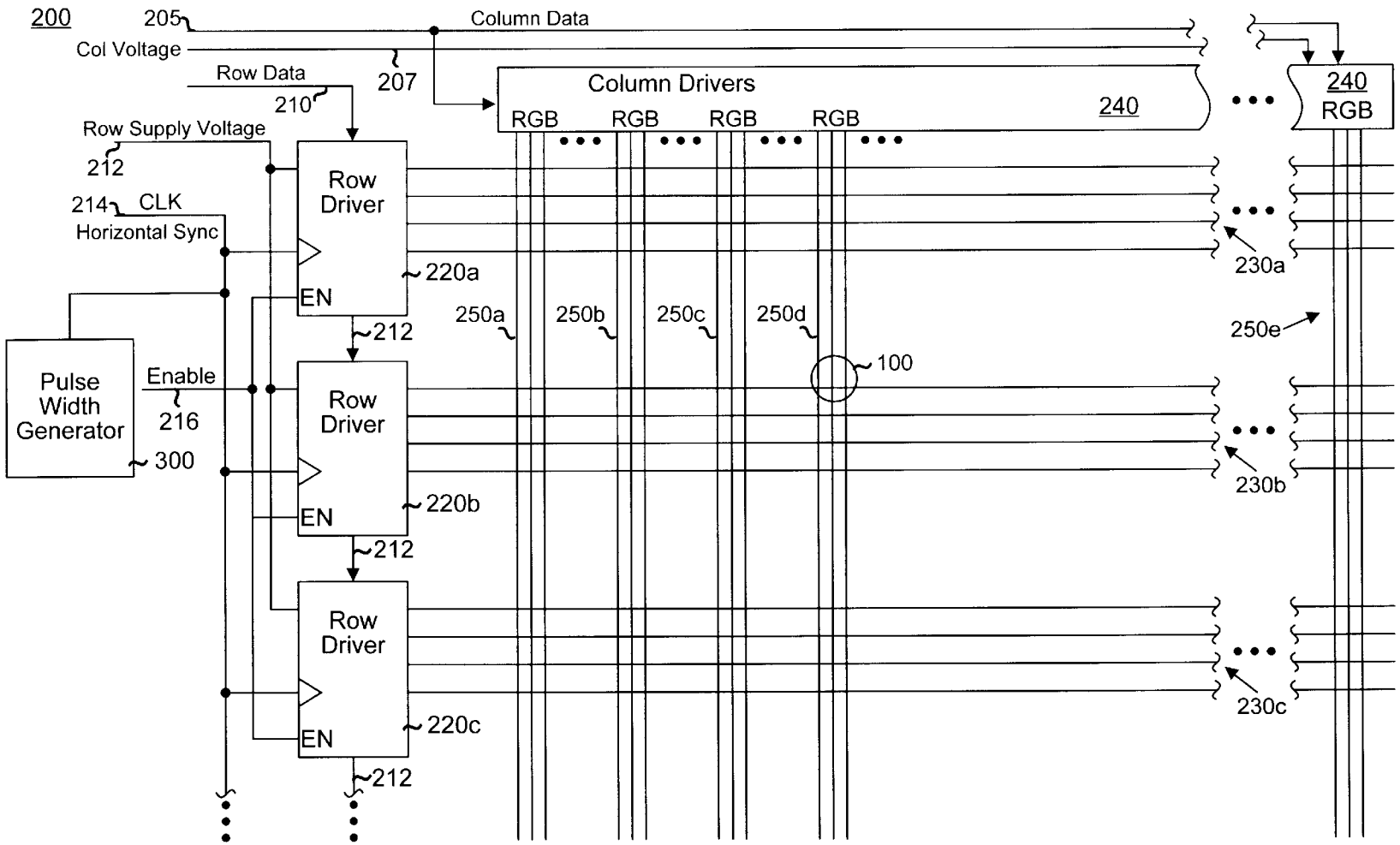
FIG. 3B illustrates a plan view of a flat panel FED screen in accordance with the present invention illustrating row and column drivers and numerous intersecting rows and columns.

FIG. 3B illustrates the circuitry of the FED flat panel display screen 200 in accordance with the present invention in more detail. Region 100, as described with respect to FIG. 2, is also shown in FIG. 3B. The FED flat panel display screen 200 consists of n row lines (horizontal) and x column lines (vertical). For clarity, a row line is called a "row" and a column line is called a "column." Row lines are driven by row driver circuits 220*a*–220*c*. Shown in FIG. 3B are row groups 230*a*, 230*b* and 230*c*. Each row group is associated with a particular row driver circuit; three row driver circuits are shown 220*a*–220*c*. In one embodiment of the present invention there are over 400 rows and approximately 5–10 row driver circuits. However, it is appreciated that the present invention is equally well suited to an FED flat panel display screen having any number of rows. Also shown in FIG. 3B are column groups 250*a*, 250*b*, 250*c* and 250*d*. In one embodiment of the present invention there are over 1920 columns. However, it is appreciated that the present invention is equally well suited to an FED flat panel display screen having any number of columns. A pixel requires three columns (red, green, blue), therefore, 1920 columns provides at least 640 pixel resolution horizontally.

Row driver circuits 220*a*–220*c* are placed along the periphery of the FED flat panel display screen 200. In FIG. 3B, only three row drivers are shown for clarity. Each row driver 220*a*–220*c* is responsible for driving a group of rows. For instance, row driver 220*a* drives rows 230*a*, row driver 220*b* drives rows 230*b* and row driver 220*c* drives rows 230*c*. Although an individual row driver is responsible for driving a group of rows, only one row is active at a time across the entire FED flat panel display screen 200. Therefore, an individual row driver drives at most one row line at a time, and when the active row line is not in its group during a refresh cycle it is not driving any row line. A supply voltage line 212 is coupled in parallel to all row drivers 220*a*–220*c* and supplies the row drivers with a driving voltage for application to the cathode 60/40 of the emitters. In one embodiment, the row driving voltage is negative in polarity.

An enable signal is also supplied to each row driver 220*a*–220*c* in parallel over enable line 216 of FIG. 38. When the enable line 216 is low, all row drivers 220*a*–220*c* of FED screen 200 are disabled and no row is energized. When the enable line 216 is high, the row drivers 220*a*–220*c* are enabled. As described with respect to FIG. 3A, a pulse width generator circuit 300 controls the enable line 216.

A horizontal clock signal is also supplied to each row driver 220*a*–220*c* in parallel over clock line 214 of FIG. 3B. The horizontal clock signal or synchronization signal pulses upon each time a new row is to be energized. The n rows of a frame are energized, one at a time, to form a frame of data. Assuming an exemplary frame update rate of 60 Hz, all rows are updated once every 16.67 milliseconds. Assuming n rows per frame update, the horizontal clock signal pulses once every 16.67/n milliseconds. In other words a new row is energized every 16.67/n milliseconds. If n is 400, the horizontal clock signal pulses once every 41.67 microseconds.

All row drivers of FED 200 are configured to implement one large serial shift register having n bits of storage, one bit per row. Row data is shifted through these row drivers using a row data line 212 that is coupled to the row drivers 220*a*–220*c* in serial fashion. During sequential frame update mode, all but one of the bits of the n bits within the row drivers contain a "0" and the other one contains a "1". Therefore, the "1" is shifted serially through all n rows, one at a time, from the upper most row to the bottom most row. Upon a given horizontal clock signal pulse, the row corresponding to the "1" is then driven for the on-time window. The bits of the shift registers are shifted through the row drivers 220*a*–220*c* once every pulse of the horizontal clock as provided by line 214. In interlace mode, the odd rows are updated in series followed by the even rows. A different bit pattern and clocking scheme is therefore used.

The row corresponding to the shifted "1" becomes driven responsive to the horizontal clock pulse over line 214. The row remains on during a particular "on-time" window. During this on-time window, the corresponding row is driven with the voltage value as seen over voltage supply line 212 if the row drivers are enabled. During the on-time window, the other rows are not driven with any voltage. As discussed more fully below, the present invention varies the size of the on-time window to alter the brightness of the FED flat panel display screen 200 of FIG. 3B. To increase the brightness, the on-time window is expanded. To decrease the brightness, the on-time window is decreased. Since the relative voltage amplitudes are not altered on the column drivers, the present invention does not degrade gray scale resolution by altering brightness in the above fashion. In one embodiment, the rows are energized with a negative voltage.

As shown by FIG. 38, there are three columns per pixel within the FED flat panel display screen 200 of the present invention. Column lines 250*a* control one column of pixels, column lines 250*c* control another column line of pixels, etc. FIG. 38 also illustrates the column drivers 240 that control the gray scale information for each pixel. The column drivers 240 drive amplitude modulated voltage signals over the column lines. In an analogous fashion to the row driver circuits, the column drivers 240 can be broken into separate circuits that each drive groups of column lines. The amplitude modulated voltage signals driven over the column lines 250*a*–250*e* represent gray scale data for a respective row of pixels. Once every pulse of the horizontal clock signal at line 214, the column drivers 240 receive gray scale data to independently control all of the column lines 250*a*–250*e* of a pixel row of the FED flat panel display screen 200. Therefore, while only one row is energized per horizontal clock, all columns 250*a*–250*e* are energized during the on-time window. The horizontal clock signal over line 214 synchronizes the loading of a pixel row of gray scale data into the column drivers 240. Column drivers 240 receive column data over column data line 205 and column drivers 240 are also coupled in common to a column voltage supply line 207.

Figure 3C:
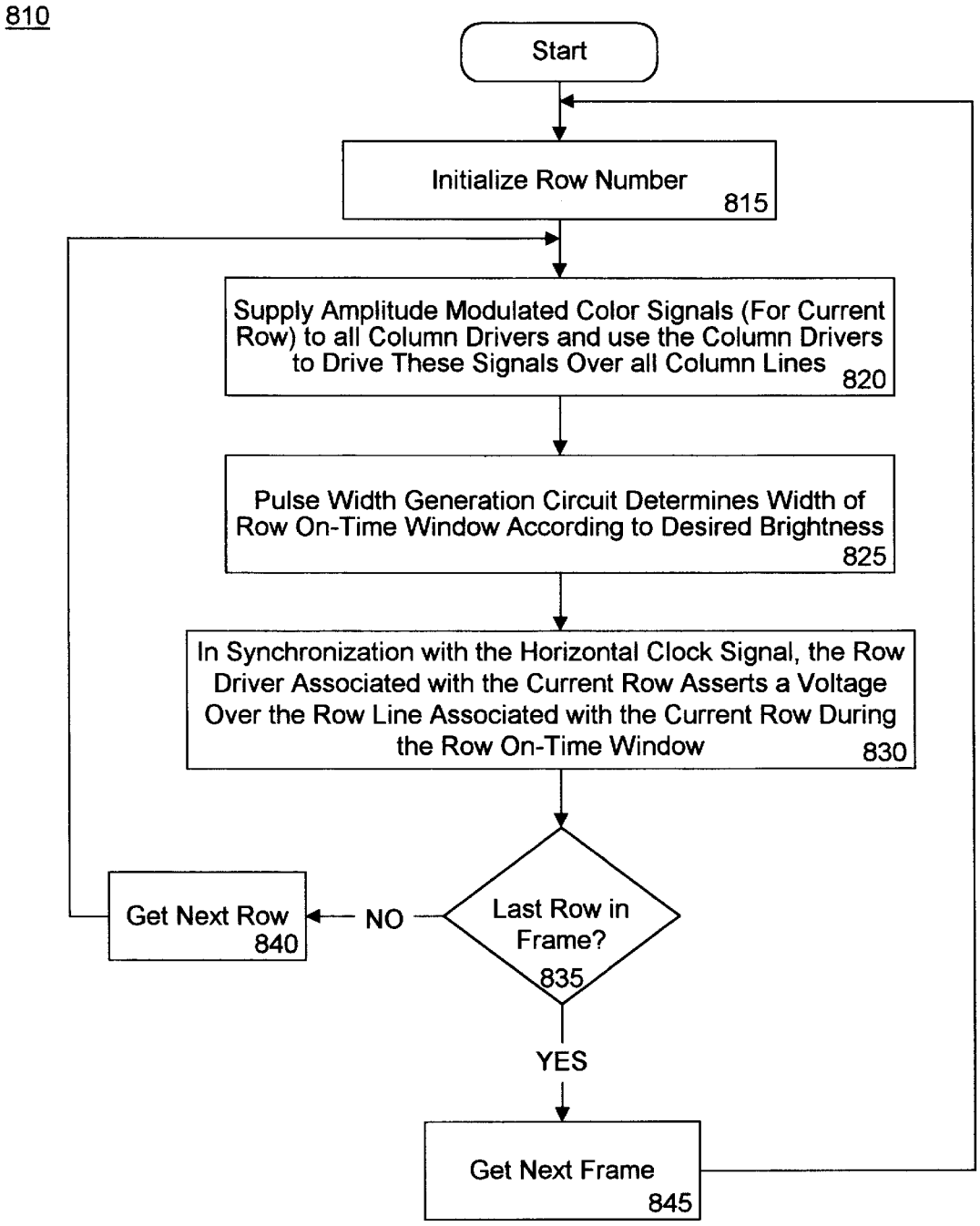
FIG. 3C is a flow diagram illustrating steps of the process performed by the brightness control circuitry of FIG. 3A in accordance with the present invention.

FIG. 3C illustrates the operational steps of the process 810 performed by the circuitry of FIG. 3A and FIG. 3B of the present invention for frame updating with uniform brightness control. At step 815, the selected row number is initially set, e.g., set to row zero. At step 820, amplitude modulated color signals are sent to the column drivers for the selected row. Different voltages are applied to the column lines by the column drivers 240 to realize different gray scale colors. In operation, all column lines are driven with gray scale data (over column data line 205). At step 825, the pulse width generator circuit 300 determines the width of the row on-time window based on some predetermined brightness setting. This value is then programmed into circuit 300. It is appreciated that step 825 can also occur before step 820.

At step 830, while the AM color data is held on the column lines, the row driver associated with the selected row is enabled in synchronization with the horizontal synchronization clock 214. The selected row is enabled during the on-time window only and then disabled. This causes a row of pixels of illuminate with the proper gray scale data. At step 835, a check is made if the selected row is the last row in the frame. If so, then step 845 is entered, if not, then step 840 is entered. At step 840, the selected row is updated so the next row is obtained. Row updating can be a sequential process or an alternating process (e.g., interlaced). Step 820 is then reentered to display the new selected row. This is then repeated for another row, etc., once per pulse of the horizontal clock signal of line 214, until the entire frame is filled.

At step 845 of FIG. 3C, the frame is fully updated and the next frame is started by entering step 815 again to reset the selected row. It is appreciated that step 825 can also be performed simultaneously with step 815. To increase speed, while one row is being energized, the gray scale data for the next pixel row is simultaneously loaded into the column drivers 240. Like the row drivers, 220*a*–220*c* the column drivers assert their voltages within the on-time window. Further, like the row drivers 220*a*–220*c*, the column drivers 240 have an enable line. In one embodiment, the columns are energized with a positive voltage.

Brightness Control Circuitry

Figure 4:
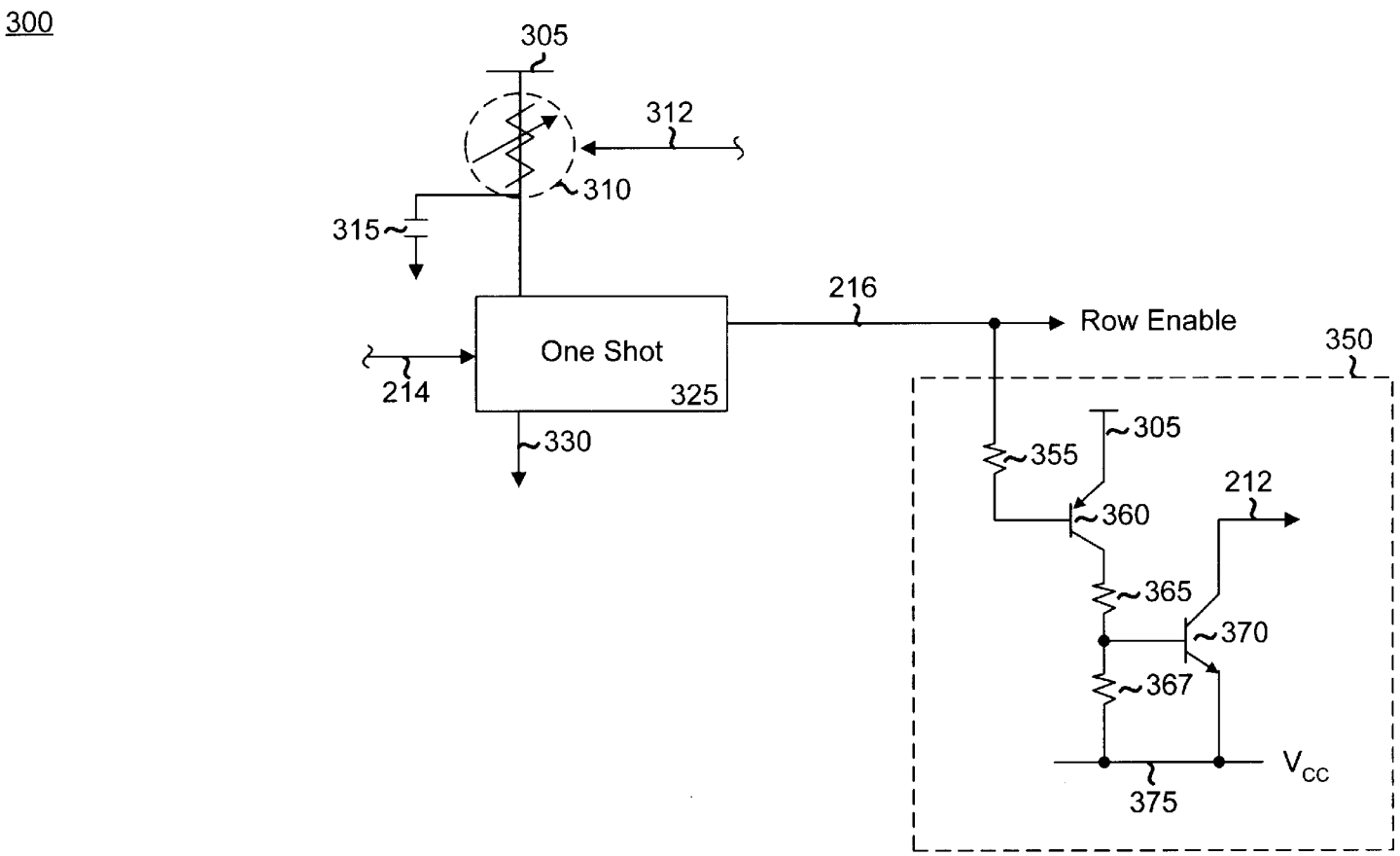
FIG. 4 is a circuit schematic illustrating circuitry utilized by the present invention for altering the brightness of the flat panel FED screen of the present invention.

FIG. 4 illustrates one exemplary embodiment of the brightness control circuitry 300 utilized by embodiments of the present invention for adjusting the brightness of the FED flat panel display screen 200 of FIG. 3B. This brightness control circuitry 300 can be situated adjacent to the row drivers 220*a*–220*c* and column drivers 240 of FED flat panel display screen 200. In a first embodiment of the present invention, the display average brightness is controlled by pulse width modulating the row voltage. The present invention utilizes pulse width modulation of the supply voltage to the row drivers 220*a*–220*c*, e.g., modulating the on-time window of the row drivers 220*a*–220*c*. In this first embodiment, the gray scale generation is controlled by amplitude modulation of the column drivers 240, e.g., by controlling the magnitude of the column driver voltages. In this case, the average brightness is linearly proportional to the row on-time window.

As the brightness is to be increased, the row on-time window is increased and as the brightness is to be decreased, the row on-time window is decreased. An advantage of this type of brightness control is that the gray scale resolution of the pixels of the FED screen 200 is not degraded as the on-time window is varied. This is the case because in this first embodiment of the present invention, neither the column data nor the column driver output voltages are altered.

Brightness control circuitry 300 of FIG. 4 includes a one shot circuit 325 coupled to a resistor and capacitor network (RC network) consisting of a voltage controlled resistor 310 and a capacitor 315. Line 330 is tied to ground or −Vcc. In accordance with the present invention, the one shot circuit 325 determines the length of the on-time period of the row drivers 220*a*–220*c* (FIG. 3B). Therefore, within the present invention, the on-time period of the row drivers 220*a*–220*c* is variable and depends on the desired brightness of the FED flat panel display screen 200. The resistance of the voltage controlled resistor 310 varies depending on the voltage over line 312 which carries a brightness signal. The voltage over line 312 varies and represents a brightness signal which is a setting indicative of the desired brightness of the FED flat panel display screen 200. The voltage over line 312 can be controlled as a result of a manual knob made user-assessable or from a circuit that performs automatic compensation or normalization (described further below) and the current state can be programmed into a memory cell. Alternatively, the voltage over line 312 can be a result of a mixture of manual and automatic origin. One end of the voltage controlled resistor 310 is coupled at node 305 to a logical level (e.g., 3.3 or 5 volts DC).

In this configuration, the RC network of FIG. 4 determines the pulse width of the one shot circuit 325 using well known mechanisms. In one embodiment, the output 216 of the one shot circuit 325 is low when active and high otherwise. Therefore, the on-time window as determined by the one shot circuit 325 is measured by its low output value in this embodiment. Also, the one shot circuit 325 is coupled to receive the horizontal synchronization pulse over line 214. Therefore, the length of the on-time window is determined by the RC network and it starts in synchronization with the horizontal clock signal received over line 214. The output of the one shot circuit 325 is coupled to drive the row enable line 216. In the first embodiment of the present invention, the circuitry 350 is not used and line 212 is directly coupled to the row driving voltage source, −Vcc 375.

Because the row driver circuits 220*a*–220*c* (FIG. 3B and of FIG. 3A) are enabled low, when the one shot 325 generates its low signal over line 216 to define the on-time window, all row driver circuits 220*a*–220*c* of FIG. 3B are enabled. However, only one row driver circuit will contain the "1" in the serial shift register. Therefore, for each pulse of the horizontal synchronization clock signal, one on-time pulse is generated to enable the row driver circuits 220*a*–220*c* for its duration.

Figure 5:
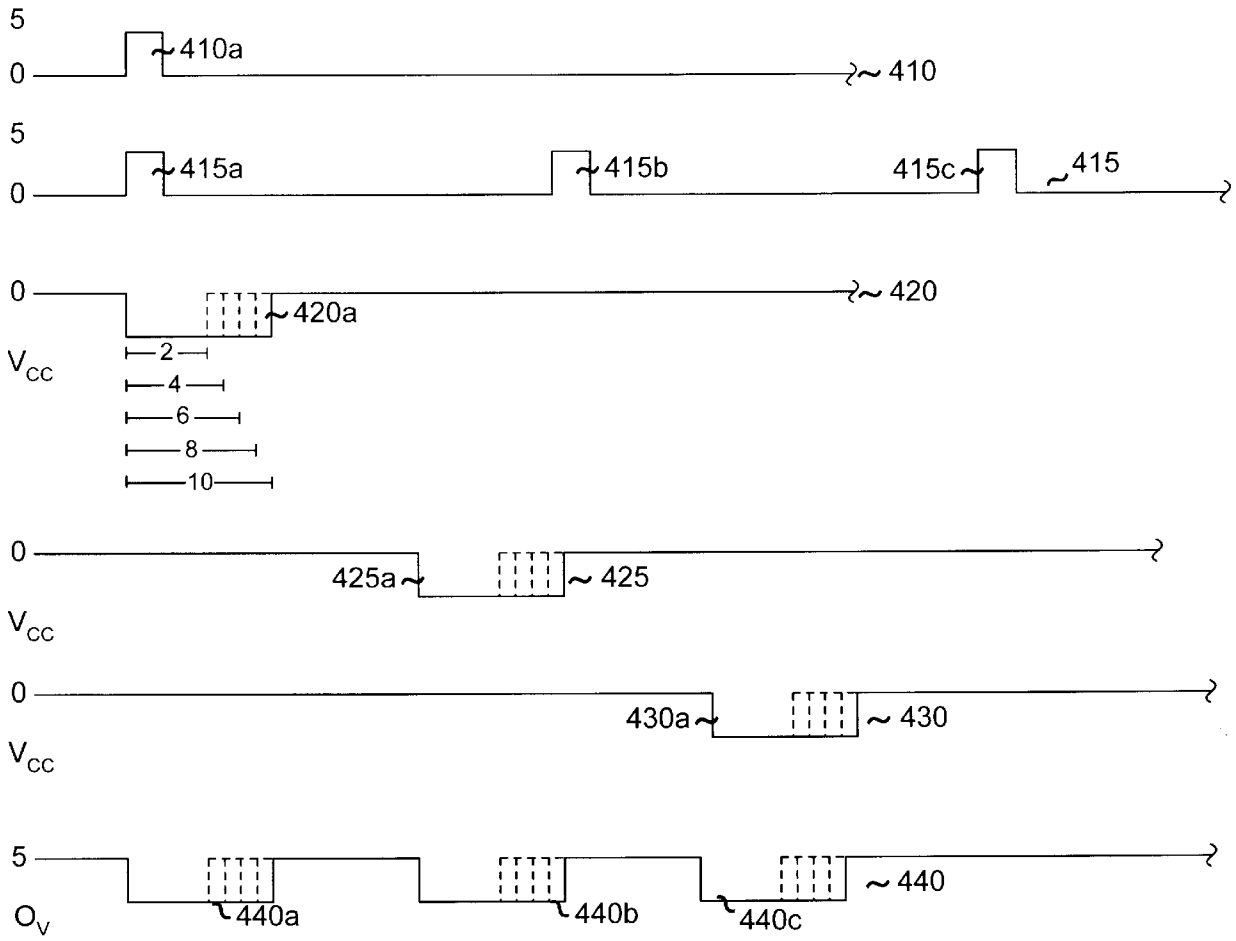
FIG. 5 illustrates timing diagrams of the signals produced by the circuit of FIG. 4 and used by the row drivers of the flat panel FED screen of FIG. 3B.

FIG. 5 illustrates a timing diagram of signals used in accordance with the present invention. Signals 410, 415 and 440 are transistor-transistor level (TTL) logic signals. Signal 410 illustrates the vertical synchronization signal and each pulse 410*a* indicates the start of a new frame. Generally, frames are presented at 60 Hz. In non-interlaced refresh mode, pulse 410*a* indicates that the first row of FED 200 is ready to be energized. Signal train 415 represents the horizontal synchronization clock signal and pulses 415*a*–415*c* represent the start timing for energizing (e.g., refreshing) the first three exemplary row lines. Each pulse of 415*a*–415*c* indicates that a new row is to be energized (e.g., a new row of pixels are refreshed). In non-interlaced refresh mode, pulses 415*a*, 415*b* and 415*c* correspond to the start of energizing of row one, row two and row three, respectively, of the rows of the FED flat panel display screen 200 (FIG. 3B).

With reference to FIG. 5, signal 440 represents the row enable signal generated by the one shot circuit 325 and transmitted over line 216 (FIG. 4) for the first three exemplary rows. Low asserted variable length pulses 440*a*–440*c* represent the on-time windows for all the row drivers 220*a*–220*c*. Variable length on-time widow pulses 440*a*–440*c* correspond, respectively, to the horizontal row synchronization clock pulses 415*a*–415*c*. During each variable length on-time window 440*a*–440*c*, only one row line of FED flat panel display screen 200 is active, as shown by the signals 420, 425 and 430. Signals 420, 425 and 430 correspond to the voltages seen over the three exemplary row lines. Driving voltage signal 420 corresponds to the first row, driving voltage signal 425 corresponds to the second row, and driving voltage signal 430 corresponds to the third row.

The dashed lines within signal 440 indicate that the on-time window is variable in pulse width depending on the current state of pulse width modulation circuit 300. For instance, signal 420 illustrates the voltage applied to an exemplary row line that is to be energized in synchronization with enable pulse 440*a*. Pulse 420*a* is the on-time window. The absolute maximum length of the on-time window can be the length of time between pulses of signal 415, e.g., from pulse 415*a* to pulse 415*b*, but can be arbitrarily set to a value less than this amount. In the example of FIG. 5, the maximum length of pulse 420*a* is arbitrarily set to about half of the period between pulses of signal 415 but could also occupy the entire period between horizontal synchronization pulses.

This on-time window (pulse 420*a*) is variable as indicated by the different periods 2, 4, 6, 8, and 10 of FIG. 5. Brightness magnitude is linearly related to the length of the on-time window within the present invention. Therefore, period 10 (in this example) represents the full application of −Vcc to the exemplary row and corresponds to the maximum brightness of the FED flat panel display screen 200. Period 8 represents 6/7 of the full −Vcc application and represents an amount 6/7 of the full brightness. Period 6 represents 5/7 of the full −Vcc application and represents an amount 5/7 of the full brightness. Lastly, Period 2 represents 3/7 of the full −Vcc application and represents an amount 3/7 of the full brightness. It is appreciated that only one period, of periods 2–10, is selected per on-time pulse and that periods 2–10 of FIG. 5 are all shown as an example of the possible brightness levels of this embodiment of the present invention. It is appreciated further that in other examples, the maximum on-time window 420*a* can be increased to encompass the entire period between pulses of signal 415.

As the brightness is to be increased, a signal over line 312 (FIG. 4) is forwarded to circuit 300 such that pulse width of pulse 420*a* increases in size from a minimum pulse width 2. Alternatively, as the brightness is to be decreased, a signal over line 312 (FIG. 4) is forwarded to circuit 300 such that pulse width of pulse 420*a* decreased in size from a maximum of pulse width 10. The same is true for the pulses 425*a* and 430*a*. Therefore, the particular pulse width (e.g., of the on-time window) of pulses 420*a*, 425*a* and 430*a* depends on the value of the voltage controlled resistor 310 of FIG. 4 which is controlled by the brightness signal over line 312.

FIG. 5 also illustrates signals 425 and 430 corresponding to two other exemplary row lines that are energized in synchronization with enable pulses 440*b* and 440*c*, respectively. Similar to pulse 420*a*, the pulse widths of pulses 425*a* and 430*a* are variable and depend on the pulse width of enable pulses 440*b* and 440*c*, respectively. For non-interlaced refresh mode, the row lines corresponding to pulses 420*a*, 425*a* and 430*a* are adjacent to each other on the FED flat panel display screen 200.

In an alternative embodiment, the row on-time window can be synchronized to the horizontal synchronization clock signal 214 such that the end of the row on-time window coincides with the start of the pulses of the horizontal synchronization clock signal 214. In this case, the row on-time window is shortened or enlarged by altering the start point of the on-time window whereas FIG. 5 illustrates examples of altering the end point of the on-time window. It is appreciated that enlarging or shortening the row on-time window does not alter the power consumption characteristics of the FED screen 200 which are based significantly on the number of pulse transitions on the row lines. In accordance with the present invention, the number of pulse transitions on the row lines remains constant whether brightness is increased or decreased.

With reference to FIG. 4, a second embodiment of the present invention is provided that is applicable in cases where the row driver circuits 220*a*–220*c* of FIG. 3B do not have enable lines. In this second embodiment, circuit 250 of FIG. 4 is used, in conjunction with one shot circuit 325, to interrupt the voltage supplied over the voltage supply line 212 that feeds the row drivers 220*a*–220*c*. In circuit 350, the TTL row enable signal 216 is coupled to a resistor 355 and used to control the gate of transistor 360. In circuit 350, transistor 360 is coupled to a logic voltage level 305 and coupled to resistor 365 which is coupled in series to resistor 367 which is coupled to −Vcc or node 375. Voltage level −Vcc is the driving voltage level for the row lines of the FED flat panel display screen 200. The node between resistor 365 and resistor 367 is coupled to control the gate of transistor 370. Transistor 370 is coupled to node 375 (−Vcc) and also coupled to line 212. Therefore, in the second embodiment of the present invention, line 212 is not directly coupled to −Vcc 375.

When the row enable line 216 is low, transistor 360 turns on causing a voltage at the gate of transistor 370 which turns on transistor 370. This causes line 212 to be coupled to −Vcc through transistor 370. Under this condition, −Vcc is supplied to all of the row drivers 220*a*–220*c* of the FED flat panel display screen 200. When the row enable line 216 is high, transistor 360 turns off causing transistor 370 to also turn off. This decouples line 212 from −Vcc. Under this condition, −Vcc is disconnected from the row drivers 220*a*–220*c* of the FED flat panel display screen 200.

Under the first embodiment of the present invention, the voltage, −Vcc, is constantly supplied to the row drivers 220*a*–220*c*, but the enable line 216 is controlled on and off to implement the proper on-time window. Under the second embodiment of the present invention, the voltage, −Vcc, is directly controlled on and off to implement the proper on-time window. It is appreciated that the signals shown in FIG. 5 are equally applicable to the second embodiment of the present invention. In the second embodiment, however, the enable line 216 does not directly control the row drivers 220*a*–220*c*, as in the first embodiment, but controls the application of the supply voltage over line 212 to the row drivers 220*a*–220*c*.

Figure 6:
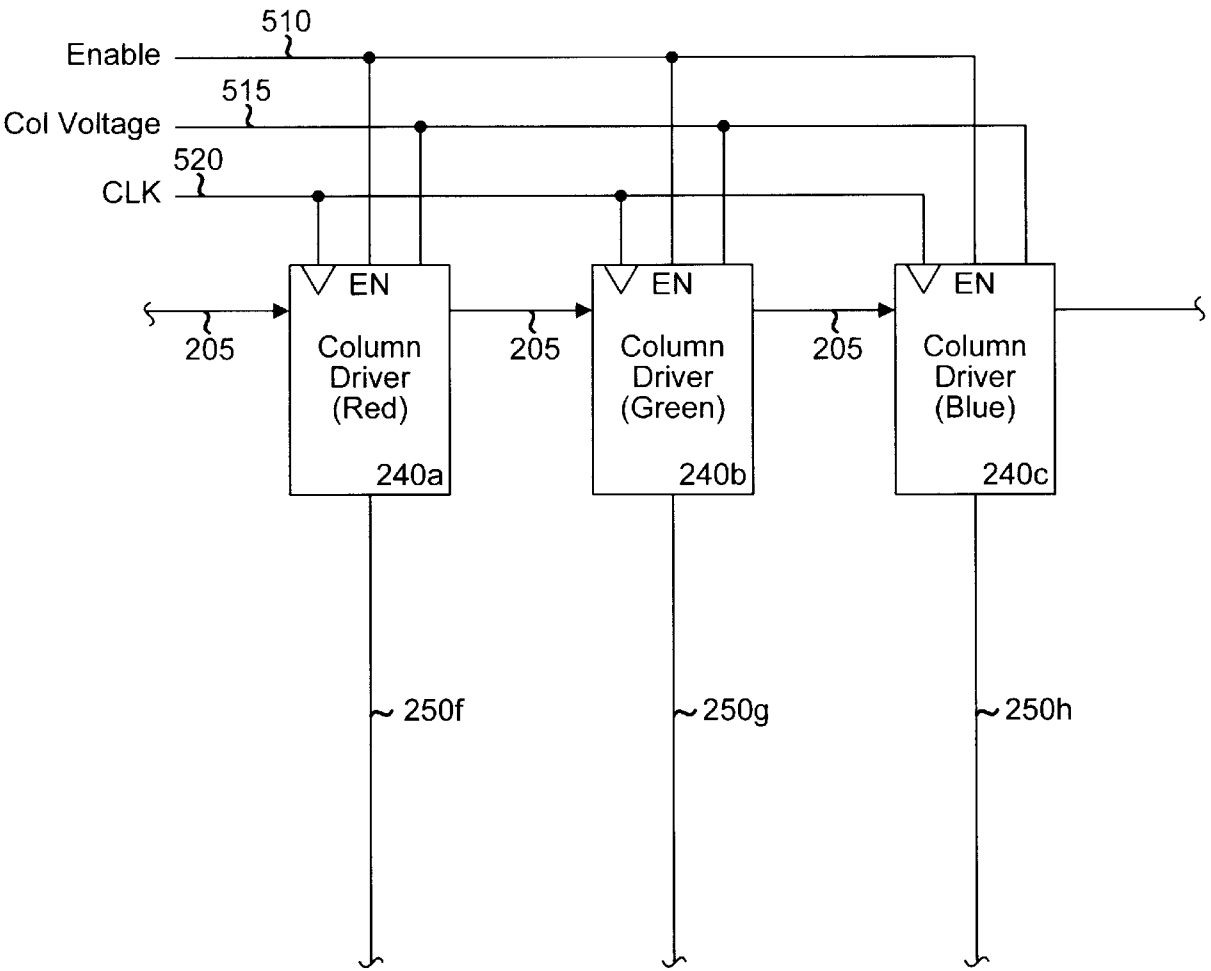
FIG. 6 is an illustration of brightness controlled column drivers of the flat panel FED screen of the present invention.

FIG. 6 illustrates a third embodiment of the present invention for adjusting the brightness of an FED flat panel display screen 200. With respect to the third embodiment of the present invention, the on-time window of the column drivers 240*a*–240*c* are adjusted and a constant on-time window is used for the row drivers 220*a*–220*c*. FIG. 6 illustrates three exemplary column drivers 240*a*–240*c* of FED flat panel display screen 200 that drive exemplary columns 250*f*–250*h*, respectively. These three columns 250*f*–250*h* correspond to the red, green and blue lines of a column of pixels. Gray scale information is supplied over data bus 250 to the column drivers 240*a*–240*c*. The gray scale information causes the column drivers to assert different voltage amplitudes (amplitude modulation) to realize the different gray scale contents of the pixel. Different gray scale data for a row of pixels are presented to the column drivers 240*a*–240*c* for each pulse of the horizontal clock signal.

Each column driver 240*a*–240*c* of FIG. 6 also has an enable input that is coupled to enable line 510 which is supplied in parallel to each column driver 240*a*–240*c*. Further, each column driver 240*a*–240*c* is also coupled to a column voltage line 515 which carries the maximum column voltage. The column drivers 240*a*–240*c* also receive a column clock signal for clocking in the gray scale data for a particular row of pixels. According to the third embodiment of the present invention, pulse width modulation is applied to the column drivers 240*a*–240*c* to implement brightness control. The longer the pulse width, the brighter the display in linear fashion. The shorter the pulse width, the darker the display.

Within this embodiment, a column enable signal is generated by circuitry analogous to that shown in FIG. 4 and this column enable signal is coupled to column driver enable line 510. The column enable line 515 causes the on-time window for the column drivers 240*a*–240*c* to become variable, depending on the desired brightness of the FED flat panel display screen 200. In the third embodiment, the column drivers 240*a*–240*c* utilize voltage amplitude modulation to realize the gray scale content, but also use pulse width modulation to vary the brightness of the FED flat panel display screen 200. The third embodiment of the present invention does not degrade the gray scale resolution of the image.

A fourth embodiment of the present invention is applicable for column drivers 240*a*–240*c* that do not have an enable input. In this case, a circuit is used analogous to circuit 350 of FIG. 4 to interrupt, e.g., turn on and off, the maximum column voltage supplied over line 515 in synchronization with the column on-time. In effect, a circuit analogous to circuit 350 is used to couple and decouple the maximum column voltage, Vcc, from line 515 and is controlled from an enable line analogous to enable line 216.

It is appreciated that the first and second embodiments of the present invention consume less power than the third and fourth embodiments because pulse width modulation of the column drivers 240*a*–240*c* requires driving against the capacitance of all the columns simultaneously whereas pulse width modulation of the row drivers 220*a*–220*c* only drives against the capacitance of a single row at a time. This is the case because during refresh, only one row is on at a time, but all columns are on so that an entire row of pixels are energized. It is further appreciated that performing brightness control using pulse width modulation, rather than using amplitude modulation, is advantageous because it does not degrade the gray scale resolution available to the FED flat panel display screen 200.

Brightness Sensor and Automatic Adjustment

Figure 7:
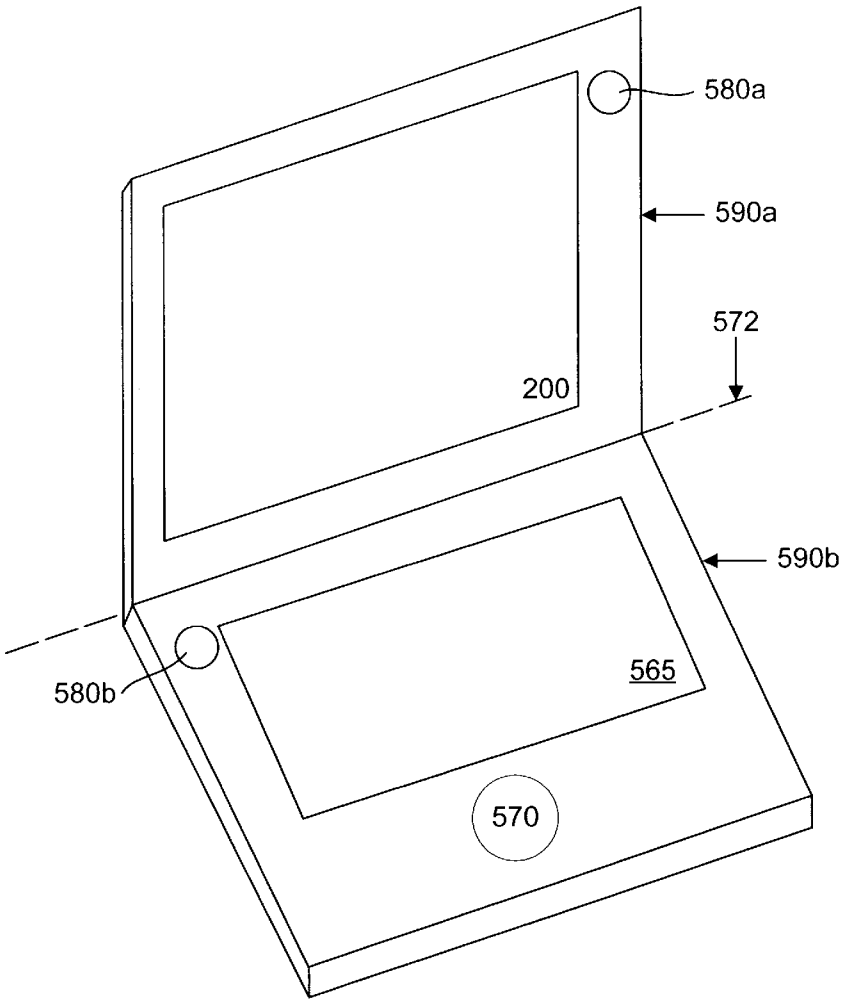
FIG. 7 is a perspective view of a computer system utilizing an ambient light sensor in accordance with one embodiment of the present invention.

FIG. 7 illustrates another embodiment of the present invention which includes an ambient light sensor 580 (FIG. 8) integrated within a general purpose computer system 550 having the FED flat panel display screen 200 therein. An exemplary portable computer system 550 in accordance with the present invention includes a keyboard or other alphanumeric data entry device 565. Computer system 550 also includes a cursor directing device 570 (e.g., a mouse, roller ball, finger pad, track pad, etc.) for directing a cursor across the FED flat panel display screen 200. The exemplary computer system 550 shown in FIG. 7 contains a base portion 590*b* and a retractable display portion 590*a* that optionally pivots about axis 572. The ambient light sensor 580 can be placed within a number of positions within the present invention and positions 580*a* and 580*b* are exemplary only. As described further below, for brightness normalization position 580*b* is advantageous and for automatic brightness adjustment position 580*a* is advantageous.

Figure 8:
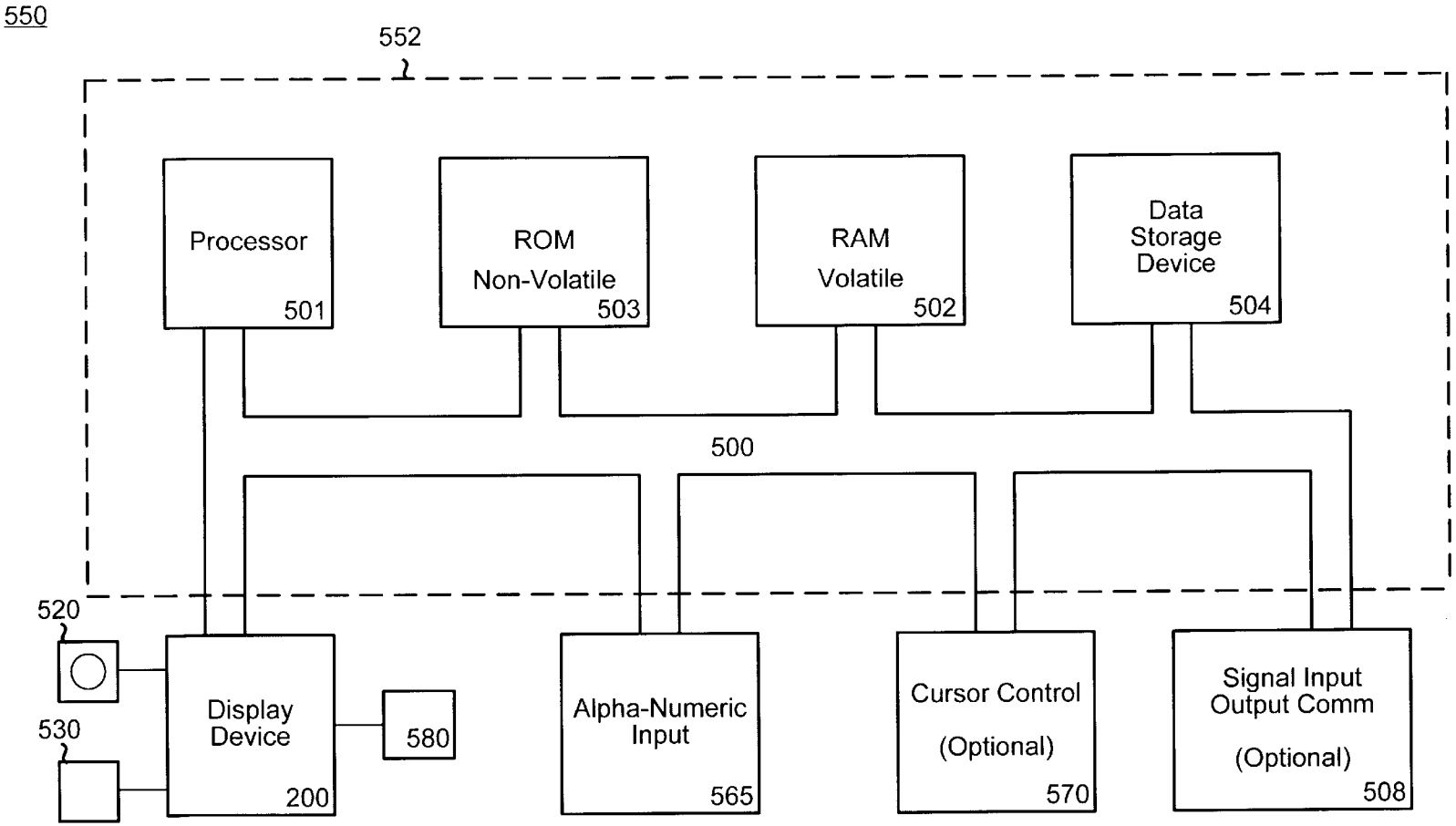
FIG. 8 is a block diagram of circuitry of a general purpose computer system including an FED screen of the present invention having an ambient light sensor.

Refer to FIG. 8 which illustrates a block diagram of elements of computer system 550. Computer system 550 contains an address/data bus 500 for communicating address and data information, one or more central processors 501 coupled to the bus 500 for processing information and instructions. Computer system 550 includes a computer readable volatile memory unit 502 (e.g., random access memory, static RAM, dynamic, RAM, etc.) coupled with the bus 500 for storing information and instructions for the central processor(s) 501 and a computer readable non-volatile memory unit (e.g., read only memory, programmable ROM, flash memory, EPROM, EEPROM, etc.) 503 coupled with the bus 500 for storing static information and instructions for the processor(s) 501.

Computer system 550 of FIG. 8 also includes a mass storage computer readable data storage device 504 such as a magnetic or optical disk and disk drive coupled with the bus 500 for storing information and instructions. The FED flat panel display screen 200 is coupled to bus 500 and alphanumeric input device 565, including alphanumeric and function keys, is coupled to the bus 500 for communicating information and command selections to the central processor (s) 501. Ambient light sensor 580 is coupled to FED flat panel display screen 200. Also coupled to FED flat panel display screen 200 is a manual brightness adjustment knob 520 and a switch 530 that controls whether or not automatic brightness adjustment features of the present invention are enabled or disabled. In one embodiment of the present invention, the manual brightness adjustment knob 520 directly controls the voltage level of the brightness signal of line 312 (FIG. 3B).

The cursor control device 570 of FIG. 8 is coupled to the bus 500 for communicating user input information and command selections to the central processor(s) 501. Computer system 500 optionally includes a signal generating device 508 coupled to the bus 500 for communicating command selections to the processor(s) 501. Elements within 552 are generally internal to computer system 550.

The present invention utilizes the ambient light sensor 580 in two embodiments. In one embodiment, as the ambient light detected by the light sensor 580 increases, the brightness of the FED screen 200 is automatically increased. Likewise, as the ambient light detected by the light sensor 580 decreases, the brightness of the FED screen 200 is automatically decreased to maintain image viewing quality. This is done to maintain image viewing quality in a setting where the ambient light intensity is changing over time or if the display is transported to different settings having different ambient light intensities. The average brightness of the FED screen 200 is adjusted according to the circuitry described with respect to FIG. 4 herein. In this first embodiment, the manual adjustment knob 530 can be used as an override and allows the user to manually adjust the FED screen's brightness level.

In a second embodiment of the present invention that uses the light sensor 580, the sensor is used to provide brightness normalization for the FED screen 200 over the FED screen's useful lifetime. This embodiment is useful for brightness correcting of the FED screen 200 over age. In this case, the light sensor 580 is positioned such that it is exposed to a substantial amount of the FED screen's own light emission. As the light detected by the light sensor 580 falls below a predetermined threshold level, the average brightness of the FED screen 200 is increased. Likewise, as the light detected by the light sensor 580 rises above the predetermined threshold level, the average brightness of the FED screen 200 is decreased. Both of the above are performed in an attempt to bring the FED screen 200 to a factory preset brightness amount over the lifetime of the FED screen 200. In this embodiment, the average brightness of the FED screen 200 is adjusted according to the circuitry described with respect to FIG. 4 herein.

Figure 9:
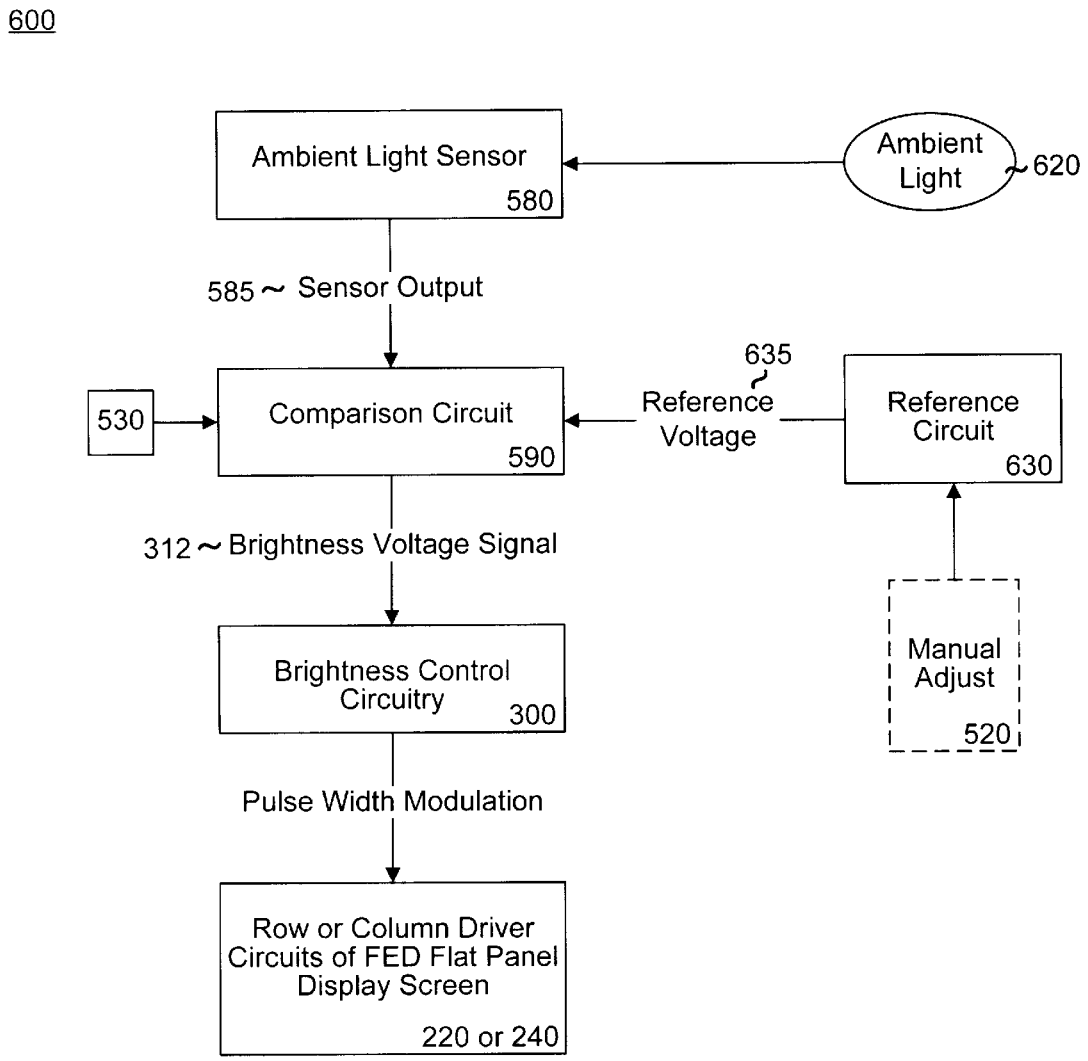
FIG. 9 is a logical block diagram of a circuit of the present invention for utilizing an ambient light sensor for automatically adjusting the brightness of an flat panel FED screen.

FIG. 9 illustrates a block diagram of the first embodiment 600 of the present invention that utilizes the ambient light sensor 580 which is sensitive to ambient light 620. In this embodiment 600, it is advantageous that the light sensor 580 not receive a substantial amount of light from the FED screen 200 itself since the light sensor 580 is to receive and respond to the ambient light in the surroundings of computer system 550. In this case, the sensor 580 can be placed in position 580*a* (FIG. 7) so that it is exposed to the ambient light but not substantially exposed to direct light from the FED screen 200.

A number of different ambient light sensors 580 can be used in accordance with the present invention. One well known line of light sensors is commercially available from Texas Instruments and another is commercially available from Burr-Brown. Light sensors 580 used in accordance with the present invention generate a variable output signal in response to and in proportion to the light detected. Depending on the light sensor used, the output signal 585 can vary in current amount, voltage amount, oscillation frequency, and in pulse width with a fixed frequency. Another type of light sensor 580 is passive and varies in resistance as the light is varied.

A comparison circuit 590 is used that receives a reference voltage signal 635 and also the output signal 585 of the sensor 580. The comparison circuit contains circuitry that generates the brightness voltage signal 312 in response to the values of signal 585 and 635. Using well known methods and components, the comparison circuit converts the sensor output signal 585 (e.g., variable current, variable frequency, variable pulse width, or variable voltage, etc.) into a converted variable voltage signal that varies in proportion to the amount of light received by sensor 580. Well known circuits and components are used at this stage. Within comparison circuit 590, if switch 530 is "OFF" then the sensor output signal 585 and the converted variable voltage signal are ignored by the comparison circuit 590. In this case, comparison circuit 590 outputs the reference voltage signal 635 over line 312. However, if switch 530 is "ON," then the converted variable voltage signal is then electrically added to the reference voltage level by the comparison circuit 590 to yield the brightness voltage signal the is output over line 312.

The reference voltage signal 635 of FIG. 9 is generated by a reference circuit 630 that is coupled to the manual brightness adjustment knob 520. In one embodiment, the manual brightness adjustment knob 520 controls a potentiometer element within circuit 630 that alters the reference voltage 635. As the manual adjustment knob 520 is adjusted to increase brightness, the reference voltage 635 is increased and as the manual adjustment knob 520 is adjusted to decrease brightness, the reference voltage 635 is decreased by circuit 630. The brightness voltage signal 312 controls circuit 300 of FIG. 9 as discussed above. In accordance with the present invention, circuit 300 can use pulse width modulation of the on-time window to control either the row drivers 220*a*–220*c* or the column drivers 240 to adjust the brightness of the FED flat panel display screen 200 as discussed in the embodiments above.

In operation, the embodiment 600 of FIG. 9 performs as follows. If switch 530 is OFF and knob 520 is adjusted for more brightness, then brightness voltage signal 312 increases in amplitude causing the on-time window of circuit 300 to increase. If switch 530 is OFF and knob 520 is adjusted for less brightness, then brightness voltage signal 312 decreases in amplitude causing the on-time window of circuit 300 to decrease. If switch 530 is ON and manual adjust 520 is constant, then brightness voltage signal 312 automatically increases in voltage in direct proportion to any increase in detected ambient light from the light sensor 580. If switch 530 is ON and manual adjust 520 is constant, then brightness voltage signal 312 automatically decreases in voltage in direct proportion to any decrease in detected ambient light 620 from the ambient light sensor 580.

Because the converted variable voltage of circuit 590 is added to the reference voltage signal 635, if switch 530 is ON and manual adjustment knob 520 is increased, the brightness voltage signal 312 increases assuming no change in ambient light 620. If switch 530 is ON and manual adjustment knob 520 is decreased, the brightness voltage signal 312 decreases assuming no change in ambient light 620. As discussed above, as the brightness signal 312 increases, the on-time window increases and the brightness of the FED screen 200 increases. Likewise, as the brightness signal 312 decreases, the on-time window decreases and the brightness of the FED screen 200 decreases.

Figure 10:
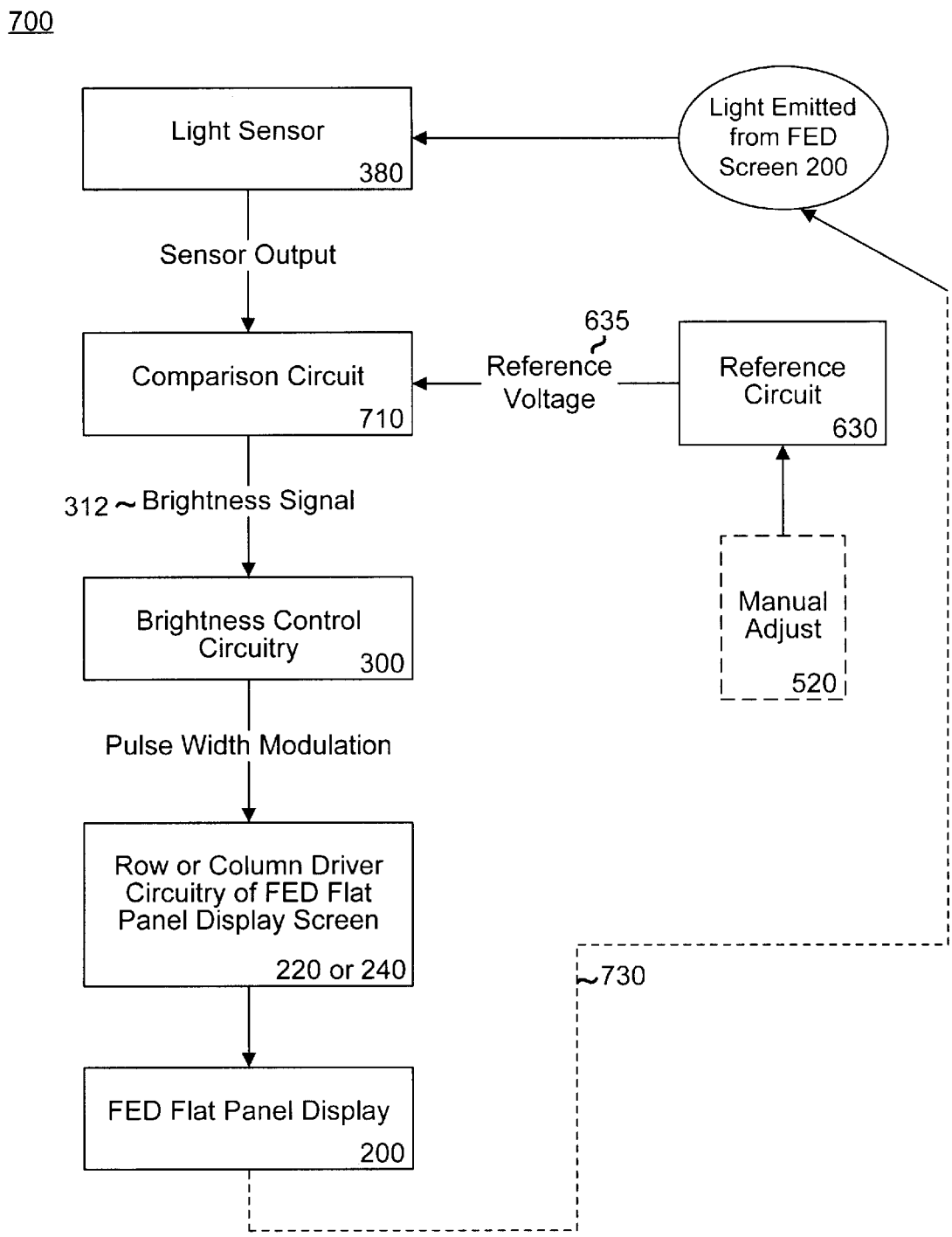
FIG. 10 is a logical block diagram of a circuit of the present invention utilizing an ambient light sensor and feed-back for automatically adjust the brightness of a flat panel FED screen for brightness normalizing.

FIG. 10 illustrates a block diagram of the second embodiment 700 of the present invention that utilizes a light sensor 580 and this embodiment performs brightness normalization for FED screen 200. Brightness normalization samples the brightness of the FED screen 200 and alters the brightness of the FED screen 200 if the sampled amount varies from a predetermined preferred level. This embodiment 700 is used to maintain the average brightness of the FED screen 200 over its useful life and also to compensate for variations in manufacturing and variations in the FED screen 200 that occur over time. In embodiment 700, it is advantageous that the light sensor 580 receive a substantial amount of light from the FED screen 200 itself as a reference source and not receive significant light from the ambient sources. In this case, the sensor 580 can be placed in position 580*b* (FIG. 7) so that it is exposed to direct light emitted from the FED screen 200 but not substantially exposed to the ambient light.

In the system 700 of FIG. 10, a negative feedback loop 730 exists between the light sensor 380 and the light emitted from flat panel FED screen 200. Therefore, the brightness control circuitry 300 adjusts the brightness at flat panel screen 200 automatically in response to the light detected by sensor 380. Also, reference circuit 630' also adjusts the reference voltage over line 635 in response to the manual adjustment knob 520. In the mode of operation where both manual adjustment and automatic screen normalization are active at the same time, manual adjustment has override priority. In operation, as the light sensor 580 detects brighter light emitted from the FED screen 200 that exceeds a factory set threshold, circuit 300 causes the on-time pulse width to decrease, thereby causing the FED screen 200 to become less bright. Likewise, as the light sensor 580 detects less bright light emitted from the FED screen 200 that is below the factory set threshold, circuit 300 causes the on-time pulse width to increase, thereby causing the FED screen 200 to become brighter. Embodiment 700 also contains the full range of manual adjustment features as described with respect to embodiment 600. That is, increasing or decrease the reference voltage over line 635 also alters the brightness displayed on flat panel FED screen 200 in the manner described with reference to FIG. 9.

System 700 is useful for automatically compensating for variations in the manufacturing of FED screens 200 and also for automatically compensating for FED screens 200 that become less bright over time as a result of age, frequency of use, prolonged use, temperature, etc. It is appreciated that the electronics required to implement system 600 and system 700 can be fabricated in the same support electronics that are used by FED screen 200 and typically situated along the periphery of the pixel array or behind the pixel array.

The preferred embodiment of the present invention, a method and mechanism to alter the brightness of an FED flat panel screen by PWM of the row drivers and AM of the column drivers, is thus described. While the present invention has been described in particular embodiments, it should be appreciated that the present invention should not be construed as limited by such embodiments, but rather construed according to the below claims.

What is claimed is:

1. A field emission display (FED) screen comprising:

a plurality of column drivers for driving amplitude modulated voltage signals over a plurality of column lines wherein each column driver is coupled to a respective column line and receives image data for said respective column line;

a plurality of row drivers for driving a voltage pulse over a plurality of row lines wherein each row driver is coupled to a respective row line, said plurality of row lines intersecting said plurality of column lines and wherein a subpixel is defined as an intersection of one row line and one column line;

an enable circuit for enabling only one row driver at a time, said enable circuit coupled to each row driver of said plurality of row drivers; and a pulse width modulation circuit for generating said voltage pulse wherein said pulse width modulation circuit is for varying the width of said voltage pulse in order to effect brightness within said FED screen without loss of gray scale resolution capability of said FED screen.

2. A field emission display screen as described in claim 1 wherein said gray scale resolution capability of said FED screen comprises 256 levels per primary color.

3. A field emission display screen as described in claim 1 wherein a pixel comprises a red subpixel, a green subpixel and a blue subpixel.

4. A field emission display screen as described in claim 3 wherein said red, green and blue subpixels all occupy the same row line and occupy different column lines.

5. A field emission display screen as described in claim 1 wherein said voltage pulse is less than 17 nanoseconds in length.

6. A field emission display screen as described in claim 1 wherein said pulse width modulation circuit effects brightness of said FED screen without altering gamma characteristics of said FED screen.

7. A field emission display screen as described in claim 6 wherein said pulse width modulation circuit effects brightness of said FED screen without altering white point balance characteristics of said FED screen.

8. A computer system comprising:

a) a microprocessor coupled to a bus;

b) a memory unit coupled to said bus;

c) an input device coupled to said bus; and d) a display screen coupled to said bus wherein said display screen is a field emission display (FED) screen comprising:

d1) a plurality of column drivers for driving amplitude modulated voltage signals over a plurality of column lines wherein each column driver is coupled to a respective column line and receives image data for said respective column line;

d2) a plurality of row drivers for driving a voltage pulse over a plurality of row lines wherein each row driver is coupled to a respective row line, said plurality of row lines intersecting said plurality of column lines and wherein a subpixel is defined as an intersection of one row line and one column line;

d3) an enable circuit for enabling only one row driver at a time, said enable circuit coupled to each row driver of said plurality of row drivers; and d4) a pulse width modulation circuit for generating said voltage pulse wherein said pulse width modulation circuit is for varying the width of said voltage pulse in order to effect brightness within said FED screen without loss of gray scale resolution capability of said FED screen wherein said brightness is linearly related to said width of said voltage pulse.

9. A computer system as described in claim 8 wherein said gray scale resolution capability of said FED screen comprises 256 levels per primary color.

10. A computer system as described in claim 8 wherein a pixel comprises a red subpixel, a green subpixel and a blue subpixel.

11. A computer system as described in claim 10 wherein said red, green and blue subpixels all occupy the same row line and occupy different column lines.

12. A computer system as described in claim 8 wherein said voltage pulse is less than 17 nanoseconds in length.

13. A computer system as described in claim 8 wherein said pulse width modulation circuit effects brightness of said FED screen without altering gamma characteristics of said FED screen.

14. A computer system as described in claim 13 wherein said pulse width modulation circuit effects brightness of said FED screen without also altering white point balance characteristics of said FED screen.

15. In a field emission display (FED) screen having a plurality of column lines intersecting a plurality of row lines, a method of adjusting the brightness of said FED screen comprising the steps of:

a) driving amplitude modulated voltage signals over said plurality of column lines using a plurality of column drivers wherein each column driver is coupled to a respective column line and receives image data for said respective column line;

b) over time, driving a voltage pulse over said plurality of row lines using a plurality of row drivers, each row driver being coupled to a respective row line and wherein said voltage pulse is driven over only one row line at a time and wherein a subpixel is defined as the intersection of a row and column line; and c) controlling said brightness of said FED screen, while maintaining gray scale resolution of FED screen, by pulse width modulation of the pulse width of said voltage pulse wherein said brightness increases with an increase in said pulse width and wherein said brightness decreases with a decrease in said pulse width.

16. A method of adjusting the brightness as described in claim 15 wherein said step c) also does not alter the gamma and white point balance characteristics of said FED screen.

17. A method of adjusting the brightness as described in claim 15 wherein said step b) comprises the step of driving said voltage pulse sequentially over said plurality of row lines, one row line at a time.

18. A method of adjusting the brightness as described in claim 15 wherein said gray scale resolution of said FED screen comprises 256 levels per primary color.

19. A method of adjusting the brightness as described in claim 15 wherein a pixel comprises a red subpixel, a green subpixel and a blue subpixel and wherein said red, green and blue subpixels all occupy the same row line and occupy different column lines.

20. A method of adjusting the brightness as described in claim 15 wherein said brightness is linearly related to the pulse width of said voltage pulse.

21. A field emission display (FED) screen comprising:

a plurality of column drivers for driving modulated voltage signals over a plurality of column lines wherein each column driver is coupled to a respective column line and receives image data for said respective column line;

a plurality of row drivers for driving a voltage pulse over a plurality of row lines wherein each row driver is coupled to a respective row line, said plurality of row lines intersecting said plurality of column lines and wherein a subpixel is defined as an intersection of one row line and one column line;

an enable circuit for enabling only one row driver at a time, said enable circuit coupled to each row driver of said plurality of row drivers; and a pulse width modulation circuit for generating said voltage pulse wherein said pulse width modulation circuit is for varying the width of said voltage pulse in order to effect brightness within said FED screen without loss of gray scale resolution capability of said FED screen.

22. A field emission display screen as described in claim 21 wherein said pulse width modulation circuit effects brightness of said FED screen without altering gamma characteristics of said FED screen.

23. A field emission display screen as described in claim 22 wherein said pulse width modulation circuit effects brightness of said FED screen without also altering white point balance characteristics of said FED screen.

* * * * *